US007025630B2

(12) United States Patent
Laverick

(10) Patent No.: US 7,025,630 B2
(45) Date of Patent: Apr. 11, 2006

(54) ELECTRICAL CONNECTOR WITH NON-BLIND CONDUCTOR ENTRY

(75) Inventor: Eric W. Laverick, Whitby (CA)

(73) Assignee: PCI Technologies, Inc., Ontario (CA)

( * ) Notice: Subject to any disclaimer, the term of this patent is extended or adjusted under 35 U.S.C. 154(b) by 0 days.

(21) Appl. No.: 10/859,961

(22) Filed: Jun. 4, 2004

(65) Prior Publication Data

US 2005/0272296 A1 Dec. 8, 2005

(51) Int. Cl.
*H01R 9/05* (2006.01)

(52) U.S. Cl. ..... 439/578; 439/584

(58) Field of Classification Search ..... 439/578, 439/744, 584, 903, 353
See application file for complete search history.

(56) References Cited

U.S. PATENT DOCUMENTS 3,678,447 A * 7/1972 Ziegler et al. ..... 439/585
3,745,512 A * 7/1973 Johnson et al. ..... 439/599
4,412,717 A * 11/1983 Monroe ..... 439/582
4,431,255 A * 2/1984 Banning ..... 439/578
4,619,496 A * 10/1986 Forney et al. ..... 439/434
4,920,643 A * 5/1990 Wilson ..... 29/876
4,981,445 A * 1/1991 Bacher et al. ..... 439/578
4,990,104 A * 2/1991 Schieferly ..... 439/578
5,312,271 A * 5/1994 Matsumoto et al. ..... 439/578
5,453,025 A * 9/1995 Wilson ..... 439/578
6,250,963 B1 * 6/2001 Wright ..... 439/589

* cited by examiner

*Primary Examiner*—Hae Moon Hyeon
(74) *Attorney, Agent, or Firm*—Blank Rome LLP

(57) ABSTRACT

An electrical connector including an outer housing that defines an inner bore between first and second open ends. The first open end being adapted to engage a mating electrical connector and the second open end being adapted to receive a conductor. A contact assembly is slidably received in the inner bore and includes a contact adapted to engage a contact of the mating electrical connector. The contact assembly is movable between a first position near the second open end of the outer housing and a second position.

20 Claims, 2 Drawing Sheets

ELECTRICAL CONNECTOR WITH NON-BLIND CONDUCTOR ENTRY

FIELD OF THE INVENTION

The present invention generally relates to an electrical connector that provides non-blind connection with a cable conductor. More specifically, the electrical connector includes a slidable contact that facilitates proper connection with the cable conductor.

BACKGROUND OF THE INVENTION

Conventional fixed center pin electrical connectors, such as coaxial connectors, allow only a blind connection with a cable conductor. The connection is blind because the operator is unable to observe the connection of the cable conductor with the contact of the electrical connector. This blind connection often results in bending of the cable conductor and/or improper connection between the conductor and the contact of the electrical connector.

Additionally, most conventional coaxial electrical connectors are formed of a metal material, such as beryllium copper (BeCu), that provides rigidity to portions of the connector, such as the contact fingers which engage a mating connector. However, forming the metallic components of the connectors with a material such as beryllium copper, is expensive.

An example of a conventional coaxial electrical connector is U.S. Pat. No. 5,611,707 to Meynier, the subject matter of which is herein incorporated by reference.

SUMMARY OF THE INVENTION

Accordingly, an object of the present invention is to provide an electrical connector that allows for a non-blind connection with a cable conductor.

Another object of the present invention is to provide an electrical connector that prevents bending of a cable conductor when engaging the cable conductor with the connector.

Yet another object of the present invention is to provide an electrical connector that is less expensive to manufacture.

The foregoing objects are basically attained by an electrical connector including an outer housing that defines an inner bore between first and second open ends. The first open end is adapted to engage a mating electrical connector and the second open end is adapted to receive a conductor. A contact assembly is slidably received in the inner bore and includes a contact adapted to engage a contact of the mating electrical connector. The contact assembly is movable between a first position near the second open end of the outer housing and a second position.

The foregoing objects are also attained by a method of connecting an electrical connector and a conductor. The electrical connector includes an outer housing that defines an inner bore between first and second open ends. The second open end is adapted to receive the conductor. A contact assembly is slidably received in the inner bore. The contact assembly includes a contact. The method includes the steps of positioning the contact assembly in the inner bore in a first position near the second open end of the outer housing so that the contact assembly is visible through the second open end; inserting the conductor into the contact assembly and electrically connecting the conductor to the contact; and sliding the contact assembly with the conductor connected thereto in the inner bore toward the first open end to a second position.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
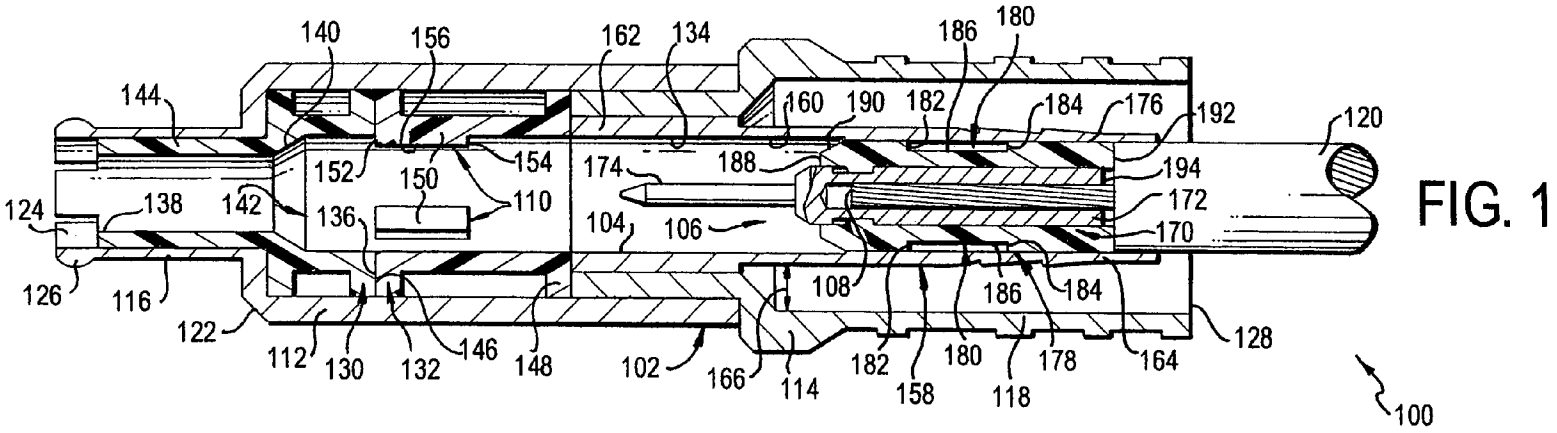
FIG. 1 is a side elevational view in section of a connector in accordance with a first embodiment of the present invention, showing an initial connection of a cable and a contact assembly of the connector in an unlocked position.
Figure 2:
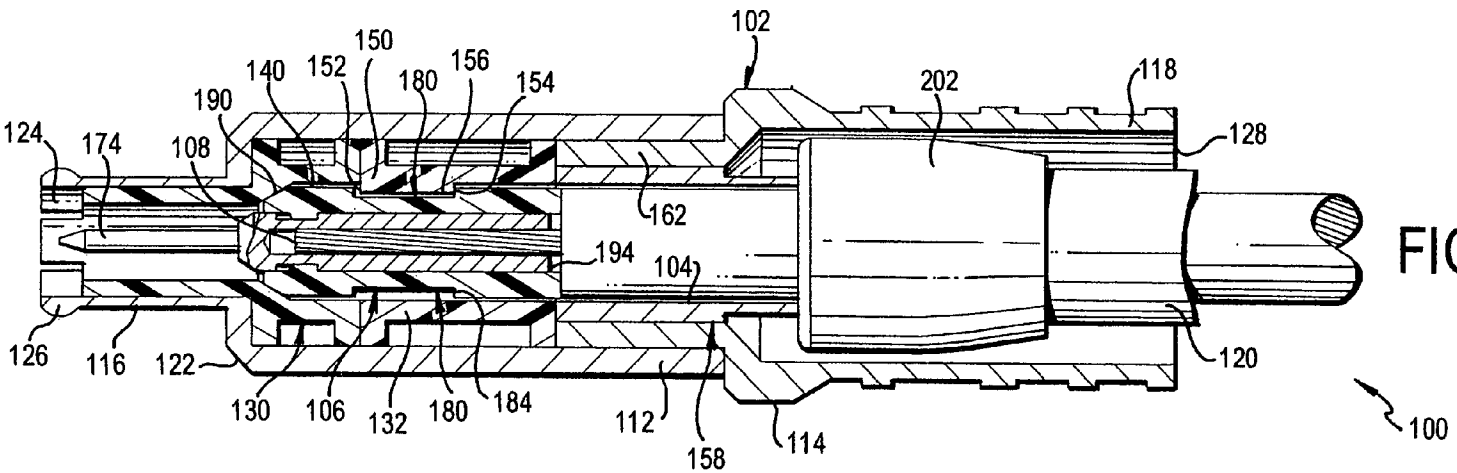
FIG. 2 is a side elevational view in section similar to FIG. 1 of the connector, showing the contact assembly in a locked position and the cable received in the connector.

Referring to FIGS. 1–2, a connector 100, such as a coaxial connector (for example, MCX, F, BNC, TNC and N connectors), in accordance with the present invention generally includes an outer housing 102 with an inner bore 104 that slidably receives a contact assembly 106 movable in the inner bore 104 between unlocked and locked positions. When in the unlocked position, as seen in FIG. 1, the contact assembly 106 is easily viewed for visible or non-blind entry of a connecting cable conductor 108 ensuring proper electrical connection between the cable conductor 108 and the contact assembly 106. Once the contact assembly 106 and the cable conductor 108 are properly connected, the contact assembly 106 slides axially within the inner bore 104 to its locked and operative position, as seen in FIG. 2, for connection with a mating connector (not shown). A retaining member 110 engages the contact assembly 106 when in its locked position to substantially restrict the movement of the contact assembly 106.

The outer housing 102 of the connector 100 is substantially cylindrical and includes first and second parts 112 and 114 that overlap in the middle of the housing 102. Each part 112 and 114 is preferably made of brass. Each end 116 and 118 of the housing first and second parts 112 and 114, respectively, is open with the first end 116 being adapted to connect with the mating connector and the second end 118 being adapted to receive cable 120 and cable conductor 108. The first end 116 has a diameter smaller than first part 112 forming a shoulder 122 therebetween. Expandable contact fingers 124 including a snapping bead 126 extend from the first end 116 for connection with the mating connector. The second end 118 includes an entry opening 128 sized to accommodate the cable 120 and its jacket with the braid folded back 202, as seen in FIG. 2.

The inner bore 104 includes first and second raised dielectric sleeves 130 and 132 raised from and extending along an inner surface 134 of the inner bore 104. The first sleeve 130 includes one end 136 abutting the second sleeve 132 and an opposite end 138 adjacent the fingers 124. A sloped transition wall 140 is disposed in the middle of first sleeve 130 defining a cavity 142 between the wall 140 and the second sleeve 132 for retaining an end of the contact assembly 106. The sloped wall 140 is about 60 degrees from center line. The first sleeve 130 includes a support portion 144 extending between the transition wall 140 and the end 138 for supporting the fingers 124. Due to the support provided by support portion 144, the fingers 124 can be made of a less rigid material, such as brass, that is also less expensive than the convention materials, such as BeCu, used to make the fingers. That also allows the entire outer housing 102, including the fingers 124, to be made of less expensive brass.

The second sleeve 132 includes one end 146 abutting the end 136 of the first sleeve 130 and an opposite end 148 abutting the end of the second part 114 of the outer housing 102 where the first and second parts 112 and 114 overlap. The retaining member 110 extends from the second sleeve 132 into the inner bore 104. With respect to the first embodiment of the present invention, the retaining member 110 can be a plurality of ribs 150 extending from the second sleeve 132. The ribs 150 are formed of a deformable and elastic material, such as TEFLON or rubber, that allows the ribs 150 to deform and snap back into place. Preferably, the ribs 150 and the second sleeve 132 are formed as a unitary one-piece member, however, the ribs 150 can formed separately and attached to the sleeve 132. Each rib 150 includes first and second shoulder walls 152 and 154 with a planar wall 156 extending therebetween. Any number of ribs 150 can be employed including a single rib.

An inner mandrel 158 is disposed in the inner bore 104. A continuous inner passageway 160 is formed between the inner mandrel 158 and the first and second sleeves 130 and 132 for slidably receiving the contact assembly 106. A first end 162 of the inner mandrel 158 contacts the second part 114 of the outer housing 102 at the overlapping connection of the first and second parts 112 and 114. An opposite free end 164 of the mandrel 158 extends toward open end 128 defining a space 166 between the mandrel 158 and the second part 114.

Disposed within the continuous inner passageway 160 of the housing inner bore 104, is the contact assembly 106. The contact assembly 106 generally includes a dielectric casing 170 that has an inner contact 172 with a conductive pin 174 extending therefrom for engaging a contact of the mating connector. The dielectric casing 170 has an outer surface 176 that includes an engagement portion 178 for engaging retaining ribs 150. The engagement portion 178 can be a recess 180 disposed in the outer surface 176 shaped to accommodate the retaining ribs 150. The recess 180 includes first and second end walls 182 and 184 with a main wall 186 extending therebetween. The recess 180 can extend continuously around the outer perimeter of the dielectric casing 170.

A first end 188 of dielectric casing 170 includes a sloped surface 190 that is about 30 degrees from center line. A second end 192 opposite first end 188 receives the exposed cable conductor 108 in an inner area 194 of the contact 172 and abuts the cable 120.

To connect cable 120 and the connector 100, the cable 120 is inserted into the opening 128 of the outer housing second part 114. The contact assembly 106 is disposed in its unlocked position near the free end 164 of the mandrel 158 so that it is easily observed by the operator. The conductor 108 of the cable 120 is inserted into the inner area 194 of the contact 172 of contact assembly 106, thereby electrically connecting the conductor 108 with the pin 174. Because the contact 172 of the contact assembly 106 is easily observed through the opening 128, the cable conductor 108 can be observed as it is being inserted into the contact 172 to avoid bending of the conductor 108. This non-blind connection ensures proper connection between the conductor 108 and the contact 172.

Once the cable conductor 108 and the contact 172 of the contact assembly 106 are properly mated, the contact assembly 106 can be moved to its locked and operative position (FIG. 2) by pushing the cable 120 into the inner bore 104 and sliding the contact assembly 106 axially within the inner passageway 160 towards the opposite end 116 of the outer housing 102. As the contact assembly 106 is moved toward the housing end 116, the sloped surface 190 of the end 188 of the contact assembly casing 170 abuts and slides along the first shoulders 154 of the retaining ribs 150 of the second sleeve 132. As the contact assembly 106 moves past the rib first shoulders 154, the sloped surface 190 and the outer surface 176 at the end 188 of the contact assembly casing 170 abut the planar walls 156 of the ribs, thereby deforming the ribs 150 toward the inner surface 160 of the inner bore 104. That allows the contact assembly 106 to slide past the ribs 150.

As the end 188 of the contact assembly 106 passes the ribs 150, the ribs 150 will flow or snap back and engage the recess 180 of the casing 170. The first wall 182 of the recess 180 abuts the second shoulder walls 152 of the ribs 150 and the second wall 184 abuts the first shoulder walls 154 of the ribs 150, thereby restricting the movement of the contact assembly 106. The end 188 of the contact assembly 106 is received in cavity 142 of the first sleeve 130 with the sloped surface 190 of the contact assembly casing 170 abutting the transition wall 140 of the first sleeve 130. The contact pin 174 extends close to the fingers 124 for connection with the mating connector.

Once the contact assembly 106 is in the locked position with the cable conductor 108 coupled thereto, the opposite end 118 of the outer housing 102 can be compressed, such as by a crimping or compressing technique, to secure the cable 120 in the connector 100.

Figure 3:
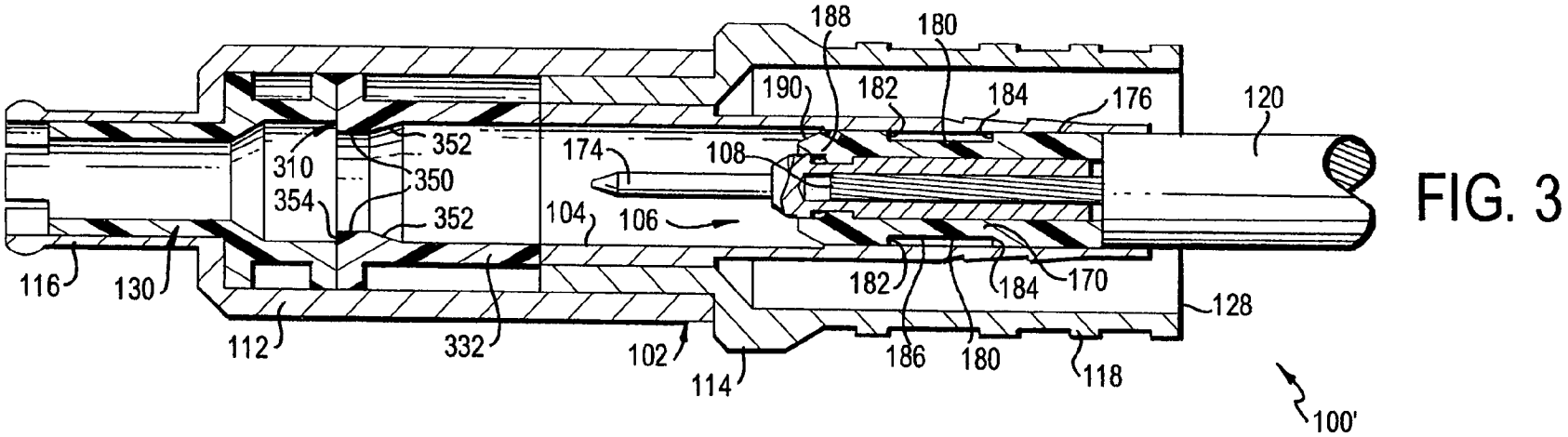
FIG. 3 is a side elevational view in section of a connector in accordance with a second embodiment of the present invention, showing an initial connection of a cable and a contact assembly of the connector in an unlocked position.
Figure 4:
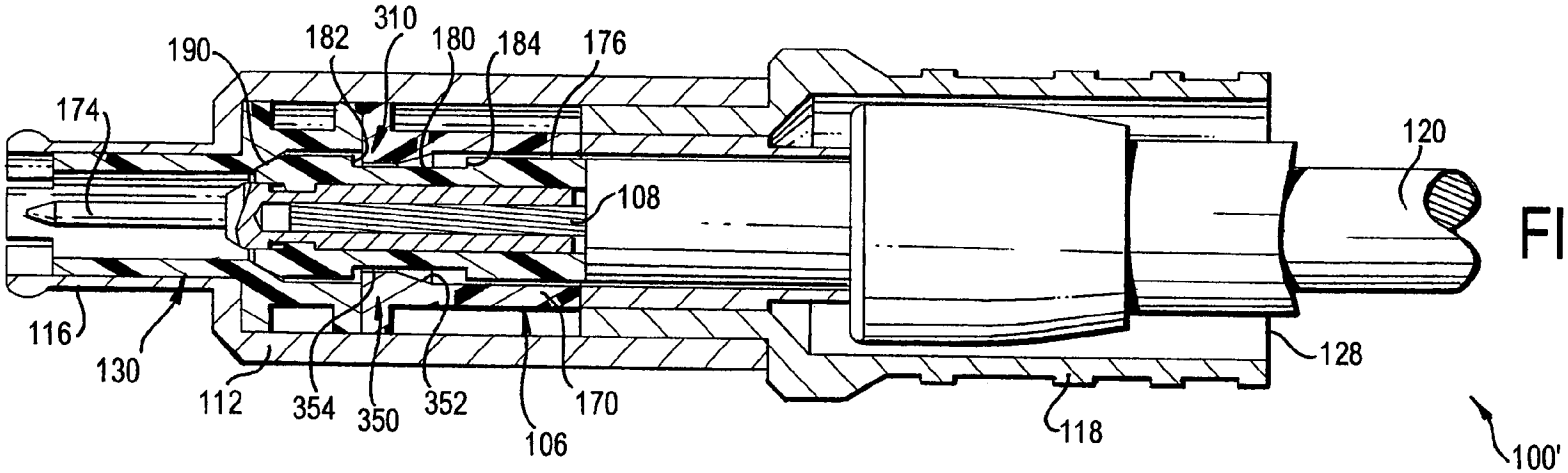
FIG. 4 is a side elevational view in section similar to FIG. 3 of the connector, showing the contact assembly in a locked position and the cable received in the connector.

Referring to FIGS. 3–4, the same reference numerals are used to refer to the same elements of the first embodiment. A connector 100' in accordance with a second embodiment of the present invention is the same as the connector 100 of the first embodiment, except that connector 100' has a different retaining member 310. Since the remaining structure of the connector 100' is the same as the connector 100 of the first embodiment, a detailed description of the connector 100', other than of the retaining member 310, is not provided.

As seen in FIG. 3, the retaining member 310 includes a shoulder 350 extending from a second sleeve 332 similar to the second sleeve 132 of the connector 100 of the first embodiment. The shoulder 350 can extend continuously around the inner bore 104. The shoulder 350 and the second sleeve 332 are preferably formed as a unitary one-piece member, however, the shoulder 350 can be separately formed and attached to the second sleeve 332. Like the ribs 150 of the first embodiment, the shoulder 350 is formed of any deformable and elastic material. The shoulder 350 includes a front sloping wall 352 and an opposite end wall 354.

The cable 120 is connected to the connector 100' of the second embodiment in the same manner as the cable 120 is connected to the connector 100 of the first embodiment. The cable conductor 108 is initially coupled with the contact assembly 106 in its unlocked position. The contact assembly 106 is then moved to its unlocked position by pushing the cable 120. The sloped surface 190 of the end 188 of the contact assembly casing 170 engages the front sloping wall 352 of the shoulder 350. As the contact assembly 106 moves past the front sloping shoulder 352, the shoulder 350 is deformed by engagement with the outer surface 176 of the casing 170. The shoulder 350 then flows or snaps back into place and engages the recess 180 of the casing 170. The end wall 354 of the shoulder 350 abuts the first wall 182 of the recess, thereby substantially restricting the movement of the contact assembly 106.

While a particular embodiment has been chosen to illustrate the invention, it will be understood by those skilled in the art that various changes and modifications can be made therein without departing from the scope of the invention as defined in the appended claims.

What is claimed is:

1. An electrical connector, comprising:

an outer housing defining an inner bore between first and second open ends, said first open end being adapted to engage a mating electrical connector and said second open end being adapted to receive a conductor; and a contact assembly slidably received in said inner bore and including a contact adapted to engage a contact of the mating electrical connector and a contact support supporting said contact, said contact assembly being movable between a first position near said second open end of said outer housing and a second position near said first open end.

2. An electrical connector according to claim 1 wherein said inner bore of said outer housing includes a retaining member; said contact assembly includes an engagement surface engaging said retaining member when said contact assembly is in said second position, thereby substantially restricting the movement of said contact assembly.

3. An electrical connector according to claim 2, wherein said retaining member includes a resilient rib extending from an inner surface of said inner bore.

4. An electrical connector according to claim 3, wherein said engagement surface of said contact assembly is a recess disposed in an outer surface of said contact assembly; and said rib being received in said recess when said contact assembly is in said second position.

5. An electrical connector according to claim 2, wherein said retaining member includes a plurality of ribs extending from an inner surface of said inner bore; and said engagement surface of said contact assembly includes a recess disposed around an outer surface of said contact assembly, said ribs engaging said recess when said contact assembly is in said second position.

6. An electrical connector according to claim 2, wherein said retaining member is a radial shoulder extending around an inner surface of said inner bore.

7. An electrical connector according to claim 6, wherein said engagement surface of said contact assembly is a recess disposed around an outer surface of said contact assembly; and said radial shoulder being received in said recess when said contact assembly is in said second position.

8. An electrical connector according to claim 6, wherein said radial shoulder is substantially continuous and includes a sloped surface for engaging said contact assembly when said contact assembly is moved from said first position to said second position.

9. An electrical connector according to claim 2, wherein said engagement surface of said contact assembly is a recess disposed around an outer surface of said contact assembly adapted to receive said retaining member.

10. An electrical connector according to claim 2, wherein said outer housing is formed of a conductive material; and said retaining member is formed of a dielectric material.

11. An electrical connector according to claim 2, wherein said engaging surface is a recess disposed in an outer surface of a dielectric casing of said contact assembly.

12. An electrical connector according to claim 1, wherein said first open end includes expandable contact fingers for engaging the mating connector; and an inner dielectric portion is disposed in said inner bore near said first open end supporting said expandable contact fingers.

13. An electrical connector according to claim 1, wherein said outer housing is formed of brass.

14. An electrical connector according to claim 1, wherein the conductor is received in said contact assembly and is electrically connected to said contact.

15. A method of connecting an electrical connector and a conductor, the electrical connector including an outer housing defining an inner bore between first and second open ends, the second open end being adapted to receive the conductor, and a contact assembly slidably received in the inner bore, the contact assembly including a contact and a contact support supporting the contact, comprising the steps of:

positioning the contact assembly in the inner bore in a first position near the second open end of the outer housing so that the contact assembly is visible through the second open end;

inserting the conductor into the contact assembly and electrically connecting the conductor to the contact; and sliding the contact assembly with the conductor connected thereto in the inner bore from the second open end toward the first open end to a second position.

16. A method according to claim 15, further comprising the step of:

engaging the contact assembly with a retaining member of the inner bore so that the contact assembly thereby substantially restricting the movement of the contact assembly.

17. A method according to claim 16, further comprising the step of:

deforming the retaining member as the contact assembly is moved from the first to second positions.

18. A method according to claim 16, further comprising the step of:

snap fitting the retaining member into a recess formed around an outer surface of a casing of the contact assembly.

19. A method according to claim 15, further comprising the step of:

compressing the second open end and the conductor, thereby securing the conductor within the connector.

20. A method according to claim 15, further comprising the step of:

moving the contact assembly until the contact is nearly flush with the first open end of the outer housing.

* * * * *